United States Patent [19]

Terzuolo

[11] Patent Number: 4,892,035

[45] Date of Patent: Jan. 9, 1990

[54] CONTINUOUS DAMPING MEANS FOR OFF-SET PRINTING MACHINES

[75] Inventor: Giancarlo Terzuolo, Turin, Italy

[73] Assignee: Grapho Engineering s.r.l., Bologna, Italy

[21] Appl. No.: 231,185

[22] Filed: Aug. 11, 1988

[30] Foreign Application Priority Data

Aug. 17, 1987 [IT] Italy ..... 67719

[51] Int. Cl.[4] ..... B41L 25/02

[52] U.S. Cl. ..... 101/148

[58] Field of Search ..... 101/147, 148, 365, 348, 101/349, 350–352, 207–210

[56] References Cited

U.S. PATENT DOCUMENTS

| | | | |
|---|---|---|---|
| 3,749,012 | 7/1973 | Lake | 101/148 |
| 3,902,416 | 9/1975 | Lake | 101/148 |
| 4,029,008 | 6/1977 | Mabrouk | 101/148 |
| 4,140,056 | 2/1979 | Mabrouk | 101/148 |
| 4,156,388 | 5/1979 | Mabrouk | 101/148 |
| 4,570,539 | 2/1986 | Ruttstedt | 101/365 |

FOREIGN PATENT DOCUMENTS

| | | | |
|---|---|---|---|
| 2849096 | 5/1980 | Fed. Rep. of Germany | 101/148 |

*Primary Examiner*—J. Reed Fisher

*Attorney, Agent, or Firm*—Cohen, Pontani & Lieberman

[57] ABSTRACT

The excess of damping liquid taken from the vessel 3 by the fountain roller 4 which rotates in the direction indicated by the arrow 6 is removed by the wiper element 9 formed of a body made of elastic material of circular cross section housed in a longitudinal groove in the rigid support bar 11. The fountain roller is rotated by the dc motor 5, the speed of which is adjusted by pulses coming from the processor 23 under the influence of the signal transmitted to the processor by the speed detector 23 which is located on the shaft of the plate roller 1. The speed can also be influenced by other signals transmitted to the processor, for instance from the keyboard 30 where it is possible to enter data relative to different characteristics of the equipment and of the damping liquid, for instance according to its viscosity. The fountain roller transfers the liquid to the duct roller 7, the peripheral speed of which is equal to that of the plate roller, or to the first of the rollers of the inking system. The wiper element is subjected in three zones of its length, preferably separated by equal spaces, to the thrust of the rods of three membranes actuated by pressure fluid. To each of these membranes can be applied a pressure which is adjustable by means of a regulating device 21 controlled by pulses coming from the processor which are created therein based on information transmitted to said processor, for instance by detectors of the relative humidity of the air and the temperature on the opposite sides of the machine and at the intermediate part thereof or in response to signals transmitted to the processor by the scanner 25 of the plate at three different strips on the peripheral surface of the plate (FIG. No. 2).

12 Claims, 3 Drawing Sheets

CONTINUOUS DAMPING MEANS FOR OFF-SET PRINTING MACHINES

FIELD OF THE INVENTION

The present invention relates to a continuous damping system with automatic regulation for offset printing machines.

BACKGROUND OF THE INVENTION

It is known that one of the requirements for the obtaining of an acceptable quality of printing is the proper damping of the nonprinting parts of the plate (or matrix) before its final inking. This damping is effected by the feeding onto the matrix of a thin layer of water to which additives are added. The layer of damping liquid applied to the matrix must be continuous in order to avoid having the ink applied onto nonprinting parts of the matrix while at the same time it must not be too thick in order to avoid the damping liquid emulsifying to beyond the correct extent the ink which is used, with substantial detriment to the quality of the printing.

One of the most widespread damping systems, the so-called "traditional" system, uses, for the damping, water to which other substances are added, primarily phosphoric acid and gum arabic. It comprises a constant-level vessel into which a feed roller, also known as "fountain roller", dips which has a chrome-plated metal surface which at times is covered by a stocking. This "fountain" roller rotates intermittently with adjustable scraping width or slowly and continuously with adjustable speed so as to adapt the amount of water fed to the requirements of the job. Squeezing rollers or systems with concentrated jets of compressed air can gradate the dosage in transverse direction.

A so-called duct roller having an elastic covering covered by swanskin or "stocking" is journaled idle on its opposite ends on two oscillating arms. It takes the layer of water from the "fountain roll" and brings it into contact with a roller parallel to it, known as the "distributor", having a chrome-plated metal surface and imparted an axial reciprocating motion and a rotating motion, driven by gears at the same peripheral speed as the plate. The water fed to the "distributor" roller is transferred by the latter to two "damping" rollers with elastic covering and also covered with a swanskin or "stocking". They rotate idly, driven by friction with the plate and the "distributor", against which the contact pressure is registered by means of adjustable supports.

In this traditional system, the amount of water applied to the plate (or matrix) can be dosed very well. However, the system is not without substantial defects.

These defects are attributable in practically all cases to the fact that the system includes rollers covered with "stocking" or swanskin. The "stockings" are in fact capable of becoming dirty with ink and of transferring traces of the latter onto nonprinting zones of the plate or "matrix", with the consequent need of providing for their cleaning and at the same time for the replacement of the damping liquid, which also becomes contaminated.

It is furthermore known that, upon the starting of the machine, the system enters into equilibrium only after having imperfectly printed several sheets, with a resultant reduction in yield of the machine during each production cycle. At the end of each of the production cycles there is also indispensable a careful maintenance of all the rollers covered with "stocking" or swanskin, which consists in removing such rollers from the machine, washing their respective "stockings" and the rollers themselves, and then returning them into place in the machine. These are relatively lengthy and costly operations.

One substantial drawback resulting from the use of the "stockings" or swanskins resides in the necessity of replacing them after a certain period of use due to the wear which they undergo during the operation and during the washings carried out for maintenance. Replacement of the "stockings" is, as is well known, a difficult operation which requires a lengthy period of restarting before again reaching equilibrium operation of the machine.

In order to obviate many of these drawbacks of the so-called "traditional" damping, there has been devised the system of continuous damping in which the damping liquid consists primarily of water comprising the addition of alcohol which is adapted to lower the surface tension of the water, with the result that each drop, upon flattening out, wets a larger area of the plate or matrix, obtaining a proper water-ink equilibrium with the use of a smaller amount of water. Furthermore, the presence of alcohol in the damping liquid has the result that the liquid evaporates more rapidly, favoring the drying out of the fresh printing. The system is, however, functional provided that the liquid is distributed in a very thin uniform film without any discontinuity.

One example of a damping device developed with the above mentioned concepts is the one devised by DAHLGREEN. It also provides for the use of a constant-level vessel containing the damping liquid at a temperature and alcohol concentration which are also constant. The ordinary "fountain" roller with chrome-plated, smooth surface dips into said vessel, driven by an independent motor of adjustable speed and with a uniform peripheral velocity much slower than that of the plate. The "fountain roller" removes a certain amount of liquid which a "dosaging" roller, covered with hydrophilic elastic material and with a perfectly smooth surface, driven by the "fountain roller" at a peripheral speed not much different from the latter, calibrates in a layer which is as thin and uniform as possible. This layer is, in part, given up to the first of the inking rollers already charged with ink, which is driven by the plate so as to advance at the same peripheral speed as the latter. The differences in the peripheral speed on contact causes a spreading out of said liquid layer or film so as to make it even thinner. The shaft of the "dosaging" roller can be brought slightly out of parallelism with respect to the shaft of the "fountain" roller so as to increase the contact pressure in the central zone in order to compensate for the effects of flexure of the rollers. The thickness of the layer of damping liquid applied to the plate being thus calibrated in first approximation on basis of the printing requirements, the adjustments are made remotely, from the outlet of the sheets, varying the speed of rotation of the "fountain roller" by manual commands. This system has the advantage of eliminating the "stocking" or swanskin coverings and the drawbacks due to them, and of assuring the continuous relatively uniform and adjustable feeding, at least in theory, in very fine manner.

However, even with this system the regulating of the damping layer is practically unrelated to the speed of the machine. This fact creates problems during the operation of the machine, since the requirements upon start-up when the machine turns slowly are obviously different from those of a machine which has reached the normal operating speed.

The thicknesses of the film of damping liquid which can be applied to the plate (or matrix) which are obtainable with this system are not comparable to those which could have been created in the case of the "traditional" damping, in which the "stocking" retained a certain amount of liquid.

It was furthermore not contemplated or possible to obtain variation of the thickness of the liquid from zone to zone in transverse direction as might be necessary in view of the differences in the temperatures of the machine in the different zones or the variable characteristics from zone to zone of the plates.

Finally, it is known that also in this case all the adjustment operations for the purpose of maintaining the thickness of the film of damping liquid applied to the plate (or matrix) constant are effected with manual controls, on the basis of what is noted, more than any way else visually by the operator of the machine.

DESCRIPTION OF THE INVENTION

An object of the present invention is therefore to provide a continuous damping system for offset printing machines which is free of the drawbacks of the known systems, and is capable of automatically providing, at any moment, the proper amount of liquid to the plate, namely neither too much nor too little, it taking automatically into account the value and variation of the parameters adapted to influence the operation of the damping and thereby the quality of the printing, and which does not suffer from the inevitable mechanical deformations of the various rollers of the damping system.

In particular, the present invention provides a continuous damping which produces a film of damping liquid which is extremely thin and which cannot be achieved with the known continuous damping system, and which further includes a control system adapted to be influenced in real time by the variation of the operating conditions of the machine, and which results in a covering of the entire surface of the plate with the same amount of damping liquid regardless of the speed of printing and the variation of other parameters such as the temperature of the various parts of the machine, the relative humidity of the air and the viscosity of the damping liquid, both in the event that said liquid contains water to which the customary additives have been added and in the event alcohol has or has not been added to the water.

In accordance with the present invention these objects are achieved by providing a continuous damping system for offset printing machines of the type in which the damping liquid is removed by means of a feed roller (fountain roller) caused to rotate by an independent motor of adjustable speed; and the damping liquid passes—in order to create a thin film of such liquid—between the part of the periphery of said feed roller and a member for gradating the dosaging thereof in transverse direction and which member contacts said part of the periphery of the fountain roller over the entire length of the latter; said member is formed of a linear wiping element of elongated shape made of elastic material; said wiping element is pressed against said part of the periphery of the fountain roller by thrust means controlled by regulating members for gradating the pressure with which the wiping element contacts said part of the periphery of the fountain roller; said adjustable speed motor which causes the rotation of the fountain roller and said regulator are controlled by processing means to which data relative to the operating parameters of the printing machine to which the system is applied are continuously transmitted.

In accordance with a preferred embodiment, said processing mean comprise a processor ("microprocessor") to which data entered by means of a keyboard can also be transmitted; all this data is processed on basis of programs ("software") which establish the relations between the said data and the optimal conditions of the damping of the plate (or "matrix") during the operation of the machine.

According to another preferred embodiment of the invention the thrust means comprise a plurality of small cylinders actuated by a pressurized fluid, the rods of the cylinder act on said wiping element from the side of the latter diametrically opposite to that facing the periphery of the fountain roller; and that each of said cylinders is fed by a pressure regulator controlled by pulses transmitted from the processor.

Another optional characteristic of the invention resides in the fact that the system includes sensors adapted to detect the temperature and relative humidity of the air substantially in the zones of the machine where the said cylinders for acting on the wiping element are located.

In accordance with another optional feature of the invention, the system also includes a plurality of devices for analyzing the structure of a peripheral strip or marking of the plate and to provide the processor with information in the form of electric pulses so as to permit the transmission to the pressure regulators associated with the cylinders corresponding to said strip of control pulses for determining thrusts necessary in order to obtain in these zones thicknesses of the film of damping liquid which are required for the optimal damping of the plate.

In accordance with another preferred embodiment of the present invention, the speed motor driving the feed roller imparts a reciprocating axial movement to means for the application of damping liquid including an elongated elastic wiper element and the means for pressing the wiper element against the surface of the feed roller.

BRIEF DESCRIPTION OF THE DRAWINGS

Other features and advantages of the invention will become evident from the following description, given solely by way of example, of a practical embodiment shown in the accompanying drawings, in which.

DESCRIPTION OF THE PRESENTLY PREFERRED EMBODIMENT

Figure 1:
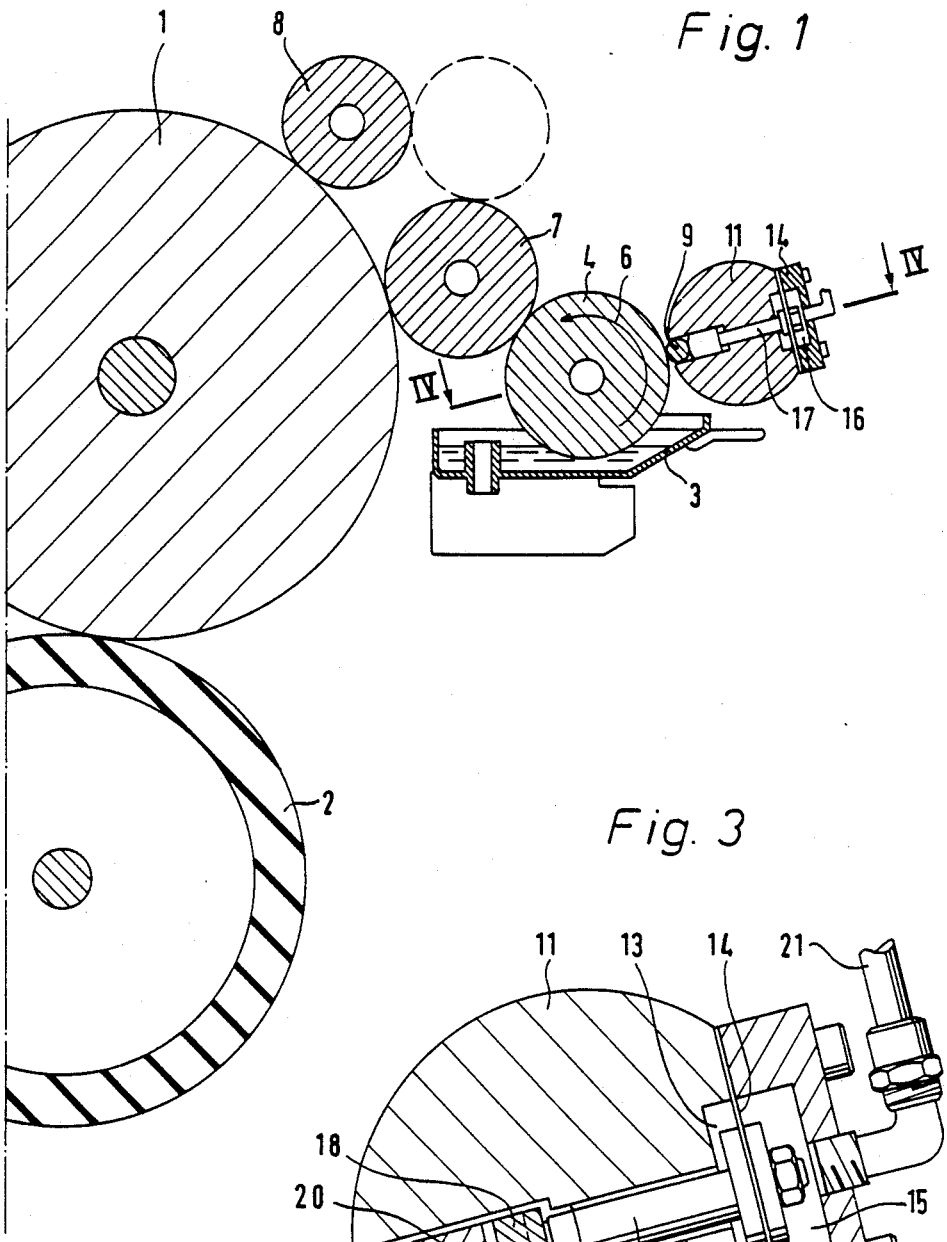
FIG. 1 is a diagrammatic view, in side elevation, of the damping device in accordance with the system of the invention, cooperating with the plate cylinder of an offset printing press.

In the drawings, 1 is the plate cylinder of an offset printing machine, cooperating, in known manner, with the rubber blanket cylinder 2.

Figure 2:
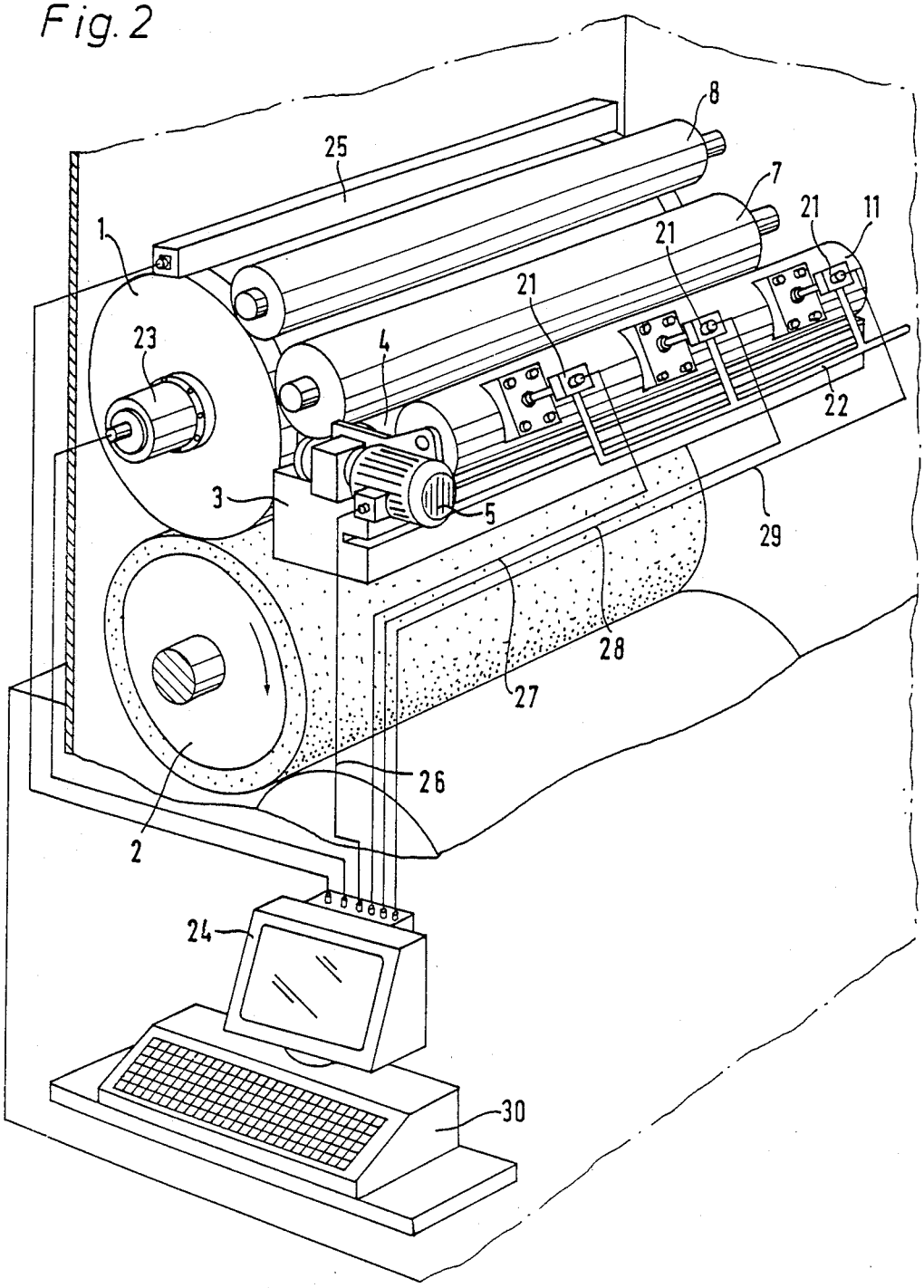
FIG. 2 is a perspective view showing the system of FIG. 1 in greater detail.

Three is the constant-level vessel which is fed in known manner with damping liquid. The feed roller 4 the so-called fountain roller, dips into said vessel. The feed roller is being driven by the dc motor 5 (FIG. 2) in such a manner as to rotate in the direction of the arrow 6, with the possibility of varying the speed of rotation thereof.

The fountain roller 4 is covered with a layer (not shown) of hydrophilic material which has on its surface microporosities for transferring the damping liquid uniformly. The fountain roller is tangent to the damping roller 7 which serves to wet the plate (not shown) applied on the periphery of the plate cylinder 1, and to wet an intermediate roller 7*a* which is arranged below the first inking roller 8 and tangent to the latter.

The part of the periphery of the fountain roller 4 opposite the region in which the damping roller 7 is arranged, is contacted, along a generatrix of the fountain roller 4, by doser or wiper element 9. Wiper element 9 is formed of an element of elongated shape, of circular cross section, made of elastic material, for instance silicone material. The length of the element 9 is equal to that of the fountain roller 4 and it is housed within a linear groove 10 the depth of which is greater than the diameter of the wiper element 9, provided in the periphery of a stationary support bar 11 (see FIG. 3).

This groove 10 communicates with preferably three continuous diametrical holes 12 arranged at equal distances between the opposite ends of the bar 11. The central hole 12 is lying in the transverse median plane of the fountain roller 4 while the lateral holes are equidistant from the opposite ends of the bar 11.

Each hole 12 communicates, from the side opposite the groove 10, with a cavity 13 formed on the outside of the body of the bar 11. The cavity 13 is divided by a membrane 14 from a cavity or chamber 15 provided in a cover 16 fastened to said body.

Figure 3:
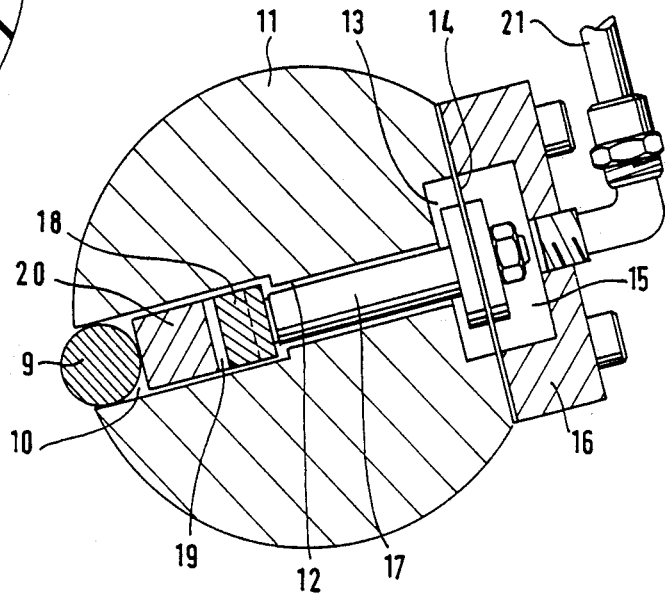
FIG. 3 is a cross-sectional view which, on a larger scale, shows a detail of construction of the damping device according to the invention.
Figure 4:
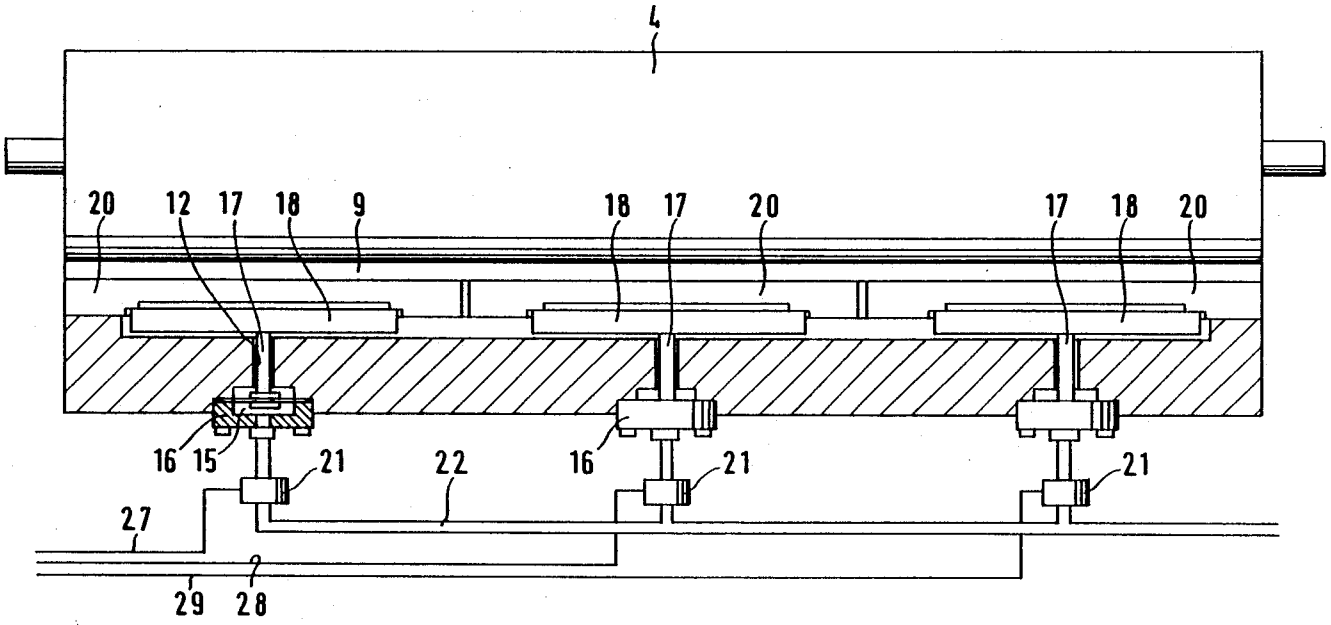
FIG. 4 is a section taken along the line IV—IV of FIG. 1.

To each membrane 14 there is attached a rod 17 which extends through the continuous hole 12 and the free end of which rests against the central part of thrust bars 18 of elongated shape, housed within the respective groove 10 at a small distance from the corresponding end. Each bar 18 is partially inserted within a cavity 19 provided in the side of the counteraction bar 20 on the side of the latter facing the end of the groove 10 and is pushed with its end against two shoulders formed at each side of said cavity 19 (FIGS. 3 and 4). The dimensions of the bars 18 and 20 and the length of the rod 17 are such that the wiper element protrudes slightly at all times from the groove 10. By feeding into the chamber 15, via a pressure regulator 21, a pressurized fluid from the line 22, it is possible to vary the thrust with which the wiper element 9 is pressed against the fountain roller 4. The length of the counter-action bars 20 is such that they exert a thrust practically over the entire length of the wiper 9.

On the shaft of the plate cylinder 1 there is disposed (see FIG. 2) the detector 23 of the speed of rotation or so-called "encoder", for transmitting signals relative to such operating parameter of the machine to the processor (or microprocessor) 24. To the latter there are also passed the signals transmitted by the reader (or so-called plate scanner) 25 of the plate which scans strips of the plate (not shown) applied to the cylinder 1. The microprocessors can also receive signals of the temperature and relative humidity of the air transmitted by detectors, which are arranged, for instance, on opposite sides of the machine.

Such signals, duly processed on basis of the corresponding software introduced into the processor are transformed into control signals transmitted by conductors 26, 27, 28 and 29, for controlling the speed of rotation of the motor 5 and, acting on the pressure regulator 21, the pressure of the fluid in the chamber 15, determining the amount of the thrust with which the rods 17 and the counteraction bar 20 of the different groups press the wiper element 9, thereby determining the thickness of the film of damping liquid which is applied to the damping roller 7 and finally to the different strips of the plate.

Furthermore, there is combined with the processor 24 the keyboard 30 through which there can be entered corrections by means of suitable software for enabling the taking into account of fixed parameters, such as the viscosity of the damping liquid.

Of course, without going beyond the principle of the invention, its details can be varied widely with respect to which has been described and shown above, without thereby going beyond the scope of the invention as defined in the accompanying claims.

Thus, for instance, omitting the keyboard 30, the processor 24 could be replaced by a simple processing circuit without thereby impairing the obtaining of an automatic continuous regulation of the thickness of the film of damping liquid as a function of the speed of rotation of the plate cylinder and of the structure of the plate.

Similarly, the means for pushing or pressing the wiper element 9 against the periphery of the fountain roller could be present in a number other than three and could be controlled by a single pressure regulator 21 which, in its turn, could be of any type known per se obtainable on the market.

The actuators which push the wiper element against the periphery of the "fountain roller" could, also be formed of a plurality of chambers with elastic walls of elongated shape aligned with each other, disposed between said wiper element and the end of the groove which houses it and communicating by pressure regulators with a line for the feeding of fluid under pressure.

In order to avoid the drawbacks due to possible deposits of small foreign bodies (powder, etc.) on the periphery of the wiper element, the group which comprises said element and the corresponding thrust or support members can, finally, be imparted a reciprocating movement obtained from the parts which drive the fountain roller.

What is claimed is:

1. An apparatus for the continuous damping of off-set printing machines comprising:

a reservoir (3) for damping liquid;

a feed roller (4) mounted for rotation and being at least partially inserted in said reservoir (3) for taking up said damping liquid by rotating therewithin;

an adjustable speed motor (5) for driving said feed roller;

means for the controlled application of said damping liquid to the surface of said feed roller; said application means extending transversely to the direction of rotation of said feed roller substantially over the entire length thereof and comprising a rigid support bar (11) having an axial peripheral groove (10) therein, said bar (11) being located at a distance from the periphery of said feed roller (4) emerging from said damping liquid; a linear elongated elastic wiper element (9) movably housed within said groove and having one side facing said feed roller and being in contact with the surface of said feed roller;

means (13–20) for pressing said wiper element against said surface of said feed roller;

means (21) in operative communication with said pressing means for regulating the pressure with which said wiper element is pressed against said surface of said feed roller; and means for controlling said adjustable speed motor (5) and said regulating means (21).

2. The apparatus according to claim 1, wherein the control means comprises means for generating data depending on the speed of said motor and the pressure of said pressing means for pressing said wiper element against said feed roller; and means (24) for processing said data.

3. The apparatus according to claim 1, wherein said pressing means is actuated by an electric motor.

4. The apparatus according to claim 2, wherein said pressing means comprises a cylinder (13–16) actuated by pressurized fluid and a rod (17) acting on said wiper element (9) on the side thereof which is diametrically opposite said side facing the periphery of said feed roller (4); said cylinder (13–16) being actuated by said pressure regulating means (21) which is controlled by pulses transmitted from said processing means (24).

5. The apparatus according to claim 2, wherein said means for generating data further comprises a sensor for detecting the temperature and relative humidity of the air located in the vicinity of the pressing means.

6. The apparatus according to claim 2, further comprising:

a plate roller (1);

a marking on the periphery of said plate roller;

means for sensing said marking and for generating an electric pulse corresponding to said marking;

means for transferring said electric pulse to said processing means (24); and means for transmitting said pulse to said pressure regulating means for regulating the thickness of said damping liquid.

7. The apparatus according to claim 1, wherein said wiping element (9) is made of elastomeric material.

8. The apparatus according to claim 4, wherein said support bar (11) further comprises a transverse cavity (12) in communication with said axial groove (10); and said rod (17) being housed for sliding movement within said cavity (12).

9. The apparatus according to claim 4, wherein said pressing means comprises a counter-action bar (20) having one side facing said wiper element (9) and a second side opposite thereto and extending parallel to and along the length of said wiper element (9);

a thrust bar (18) having a first and second side; said first side being in operative communication with said second side of said counter-action bar (20) for transmitting a force to said counter-action bar (20) and said wiper element (9); and wherein said pressing means is cooperating with said second side of said thrust bar (18) for transmitting a force thereto.

10. The apparatus according to claim 9, wherein said pressing means (13–20) further comprises a first chamber (13) and a second chamber (15);

an elastic membrane (14) interposed therebetween;

said rod (17) having one end in contact with said thrust bar (18) and a second end extending through said first chamber (13) and being operatively connected to said membrane (14) and movable therewith for translating the movement of the membrane thereto;

said second chamber (15) being in communication with said pressurized fluid regulated by said regulating means (21) for transmitting a force to said membrane (14), said rod (17), said thrust bar (18), said counter-action bar (20) and said wiper element (9).

11. The apparatus according to claim 1, wherein said periphery of said feed roller (4) is covered with a layer of hydrophilic material having on its surface microporasities for uniform transfer of said damping liquid.

12. The apparatus according to claim 1, wherein said adjustable speed motor (5) driving said feed roller (4) imparts a reciprocating axial movement to said application means and said pressing means (13–20).

* * * * *